US007530525B2

(12) United States Patent
Yang et al.

(10) Patent No.: US 7,530,525 B2
(45) Date of Patent: May 12, 2009

(54) HOLDER FOR PAPER TOWEL ROLLS

(75) Inventors: Frank Yang, Rancho Palos Verdes, CA (US); Joseph Sandor, Santa Ana Heights, CA (US); Myk Wayne Lum, Irvine, CA (US); Adam C. Wade, Rancho Santa Margarita, CA (US)

(73) Assignee: Simplehuman LLC, Torrance, CA (US)

( * ) Notice: Subject to any disclaimer, the term of this patent is extended or adjusted under 35 U.S.C. 154(b) by 635 days.

(21) Appl. No.: 11/094,808

(22) Filed: Mar. 29, 2005

(65) Prior Publication Data

US 2006/0219837 A1 Oct. 5, 2006

(51) Int. Cl.
*B65H 16/04* (2006.01)

(52) U.S. Cl. ..... 242/597.3; 242/597.4; 242/597.6; 242/597.7

(58) Field of Classification Search ..... 242/597, 242/597.3, 597.4, 597.6, 597.7; D6/521–524, D6/518; 206/389
See application file for complete search history.

(56) References Cited

U.S. PATENT DOCUMENTS

| | | | |
|---|---|---|---|
| 1,684,190 | A | 9/1928 | Moser |
| 1,713,277 | A | 5/1929 | Goldberg et al. |
| D155,897 | S | 11/1949 | Huntington |
| 3,326,489 | A | 6/1967 | Lessler |
| 3,370,805 | A | 2/1968 | Barbee |
| 3,829,034 | A | 8/1974 | Mickelson |
| 3,863,856 | A | 2/1975 | Conlon |
| 3,937,411 | A | 2/1976 | Vogel et al. |
| 4,030,676 | A | 6/1977 | Bardsley |
| 4,487,376 | A | 12/1984 | Compton |
| 4,690,345 | A | 9/1987 | Cotey |
| 4,720,053 | A | 1/1988 | Vance |
| 4,738,385 | A | 4/1988 | Bell |

(Continued)

FOREIGN PATENT DOCUMENTS

| | | |
|---|---|---|
| DE | 3613988 | 9/1987 |

(Continued)

OTHER PUBLICATIONS

Website page, www.oxo.com, Grip & Rip Paper Towel Holder—Stainless Steel, OXO International, Apr. 2004.

(Continued)

*Primary Examiner*—William A Rivera
(74) *Attorney, Agent, or Firm*—Liu & Liu

(57) ABSTRACT

A paper towel holder facilitates tearing of paper towels from a continuous roll of paper towels supported on the holder, and prevents excessive unraveling of the roll. A portable paper towel holder has a vertical pole and a base having an annular rim of uneven height. The uneven annular rim provides the combination of tall and short sections to balance between effectively holding the towel from excess unraveling, and facilitating ease of tearing of paper towel pieces from the roll. A releasable handle is provided at the distal end of the pole to securely retain the paper towel roll on the vertical pole. The handle is provided with recessed releasing buttons for releasing the handle from the pole. Another embodiment provides a paper towel holder that is structured for mounting to a vertical surface. A spring is provided to provide a bias in the axial direction of the roll.

21 Claims, 13 Drawing Sheets

U.S. PATENT DOCUMENTS

| | | | | |
|---|---|---|---|---|
| D298,290 | S | 11/1988 | Wilkerson | |
| D298,597 | S | 11/1988 | Bell | |
| 5,135,179 | A | 8/1992 | Morano | |
| 5,170,956 | A | 12/1992 | McTaggart | |
| 5,477,709 | A * | 12/1995 | Rowe | 242/597.4 |
| 5,645,247 | A | 7/1997 | Voigt | |
| 5,718,108 | A * | 2/1998 | Oppl et al. | 242/597.4 |
| D398,466 | S | 9/1998 | Odom | |
| 5,938,141 | A | 8/1999 | Kanbar | |
| D432,826 | S | 10/2000 | Shimbo et al. | |
| 6,302,348 | B1 | 10/2001 | Lillelund et al. | |
| D450,962 | S | 11/2001 | Hundley | |
| 6,467,717 | B1 * | 10/2002 | Pedicano et al. | 242/597.7 |
| 6,478,246 | B2 | 11/2002 | Fahringer | |
| D477,730 | S | 7/2003 | Hoernig | |
| D486,333 | S | 2/2004 | Hoernig | |
| D489,558 | S | 5/2004 | Snell | |
| 6,776,368 | B1 | 8/2004 | Duncan et al. | |
| D499,916 | S | 12/2004 | Yang et al. | |
| 6,832,739 | B1 | 12/2004 | Kraus | |
| D520,278 | S | 5/2006 | Mariano et al. | |
| D520,785 | S | 5/2006 | Joseph | |
| 7,140,573 | B1 | 11/2006 | Jerstroem et al. | |
| D548,504 | S | 8/2007 | Yang et al. | |
| 7,264,197 | B2 * | 9/2007 | Yu | 242/597.7 |
| 2002/0070308 | A1 | 6/2002 | Fahringer | |
| 2002/0130211 | A1 | 9/2002 | Kerr | |
| 2003/0029961 | A1 | 2/2003 | Hollinger | |
| 2006/0284001 | A1 * | 12/2006 | Paradise et al. | 242/597.4 |
| 2007/0176043 | A1 | 8/2007 | Yu | |
| 2007/0235581 | A1 | 10/2007 | Charochak | |

FOREIGN PATENT DOCUMENTS

| | | |
|---|---|---|
| EP | 473247 | 3/1992 |

OTHER PUBLICATIONS

Website page, www.oxo.com, Grip & Rip Paper Towel Holder—White, OXO International, Apr. 2004.
Website page, www.cooking.speedera.net, Apr. 2004.
Website page, http://store.yahoo.com/organizeeverything1, Grip & Rip Paper Towel Holder by OXO—Stainless Steel Model, Apr. 2004.
Website page, http://store6.yimg.com/I/organizeeverything1, Apr. 2004.
Website page, http://store.yahoo.com/organizeeverything1, Grip & Rip Paper Towel Holder by OXO—White Model, Apr. 2004.
Website page, http://www.cooking.com, OXO Stainless Steel Paper Towel Holder, Mar. 2007.
Website page, http://www.cooking.com, OXO Stainless Steel Paper Towel Holder, Apr. 2004.
Website page, www.oxo.com, Simply Tear Paper Towel Holder—Stainless Steel, OXO International, Mar. 2007.

* cited by examiner

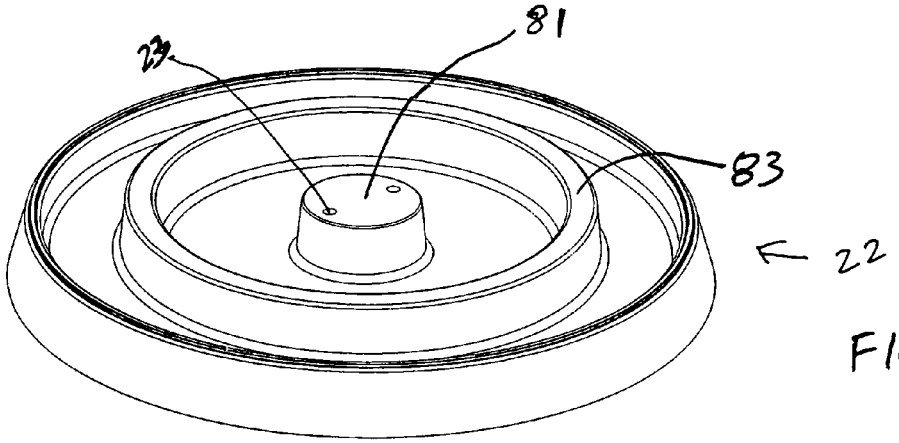
FIG. 6
FIG. 7
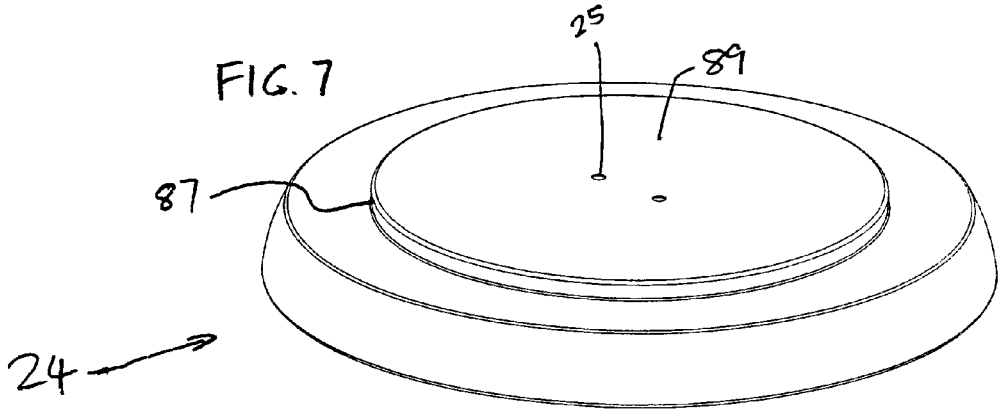
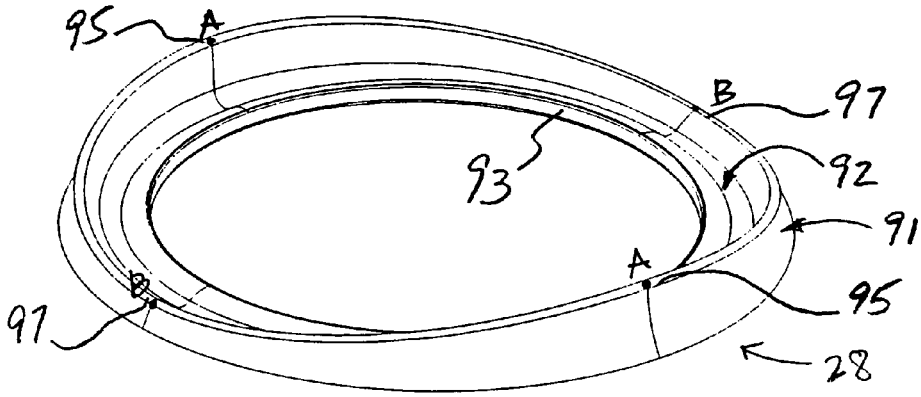
FIG. 8

FIG. 9
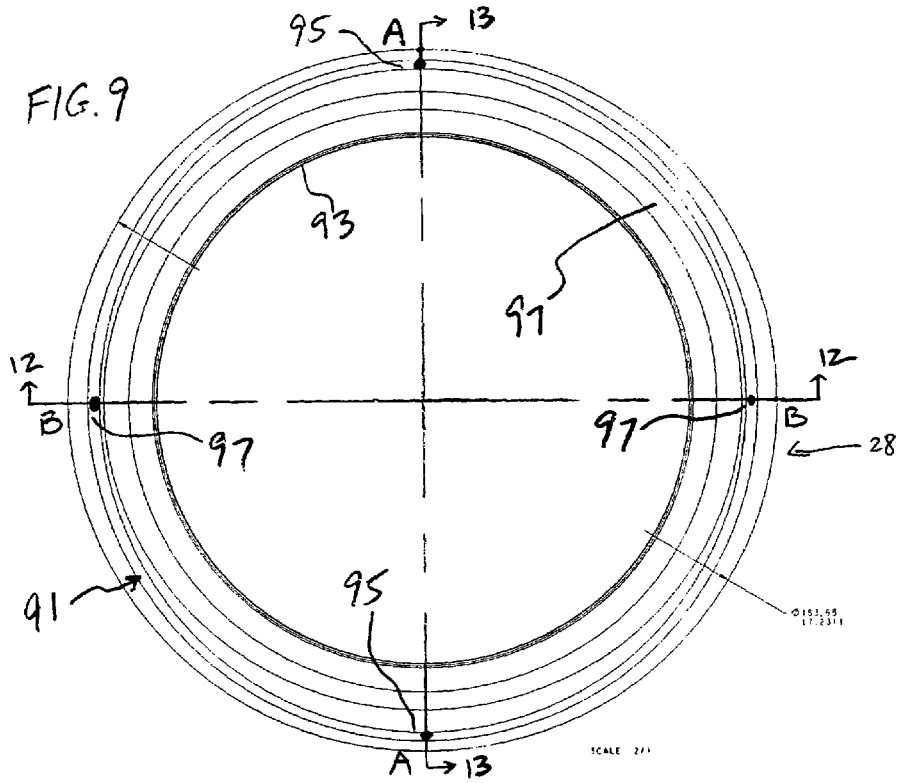
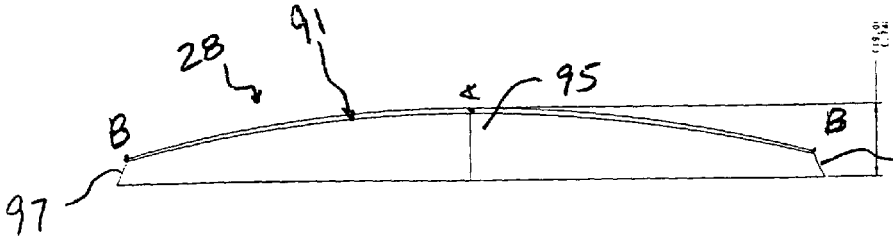
FIG. 10
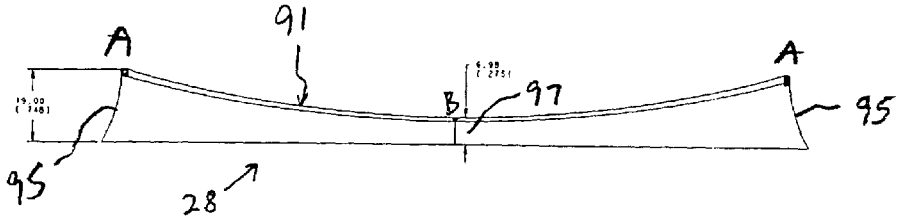
FIG. 11

HOLDER FOR PAPER TOWEL ROLLS

This application makes a claim of priority from co-pending U.S. Design Application No. 29/223,227 entitled "Wall Mount Paper Towel Holder", filed Feb. 9, 2005 in the name of Yang et al., said application being hereby incorporated by reference as if fully set forth herein.

FIELD OF INVENTION

The invention relates to holders for holding and dispensing paper towel rolls.

BACKGROUND OF INVENTION

Paper towel rolls are commonly used for household cleaning tasks. Within the roll, paper towels are defined in a continuous roll, by perforations across the roll. Holders have been designed to securely support the paper towel rolls at convenient locations for dispensing to users. One type of paper towel holder supports the paper towel roll with its axis oriented horizontally with respect to end supports. Another type of paper towel holder supports the paper towel with its axis oriented vertically with respect to a base. In the past, horizontal paper towel holders are mounted to a vertical support surface (e.g., wall-mounted), and vertical paper towel holders are free-standing on its base. Because of the vertical orientation of the paper towel in a vertical holder, the paper towel roll has a tendency to unravel as the towel roll relaxes under its own weight. Further, some of the past designs do not provide user with an easy way of tearing a piece of towel from the roll without dragging and unrolling too much of the roll on the holder.

U.S. Pat. No. 4,030,676 describes a vertical paper towel holder with a pole extending vertically from a base. The vertical pole includes a fixed handle for users to grasp and lift the holder. An annular rim of uniform height is provided at the edge of the base. According to the patent disclosure, the annular rim facilitates detachment of individual towel segment from the roll. However, it has been found that such design has its limitations, and often do not work as well as disclosed.

What is needed is an improved paper towel holder that facilitates ease of dispensing of paper towels from a roll.

SUMMARY

The present invention provides a novel paper towel holder that facilitates tearing of thin ply sheets from a roll, such as paper towels from a continuous roll of paper towel, supported on the holder, and prevents excessive unraveling of the roll.

In one aspect of the present invention, a vertical paper towel holder having a base and a vertical pole is provided with an annular rim of uneven height at the periphery of the base. The shorter sections of the rim do not present too much obstruction to the necessary unrolling of the roll when a piece of paper towel is pulled before it is to be torn off. The taller sections of the annular rim provide sufficient structure to prevent excessive unraveling of the roll, and to present a structure that facilitates the tearing of the piece of paper towel from the roll. The uneven annular rim having the combination of tall and short sections provides an ideal balance between effectively holding the towel from excess unraveling, and facilitating ease of tearing of paper towel pieces from the roll. In one embodiment of the present invention, the annular rim is made of plastic, which is fitted on a base made of metal, such as stainless steel. The metal base provides a sturdy platform with a durable finish. The plastic rim enables sufficient height that is effective at preventing unraveling of the roll. It has been found that metal such as stainless steel may not be as suitable a material as plastic to as easily form the rim of sufficient height.

In another aspect of the present invention, a releasable handle is provided at the distal end of the vertical pole. The handle is used to securely retain a paper towel roll on the vertical pole, and provides a convenient structure for the user to grab on to when lifting the holder. The handle is provided with releasing buttons for releasing the handle from the pole. These buttons are recessed flush with the external profile of the handle. The recessed buttons prevent accidental release of the handle when the user places the palm of her hand on the handle.

In a further aspect, the present invention provides a paper towel holder that is structured for mounting to a vertical surface, such as a wall or the side of a cabinet. Instead of an annular lip to facilitate tearing of individual pieces of towel from the roll, a spring is provided to provide a bias in the axial direction, thus creating resistance to the unrolling of the roll, to facilitate tearing of the paper towel from the roll. The roll is prevented from excessive unraveling by the vertical mounting.

BRIEF DESCRIPTION OF DRAWINGS

For a fuller understanding of the nature and advantages of the invention, as well as the preferred mode of use, reference should be made to the following detailed description read in conjunction with the accompanying drawings. In the following drawings, like reference numerals designate like or similar parts throughout the drawings.

FIG. 6 is a perspective view of the weight in the base, in accordance with one embodiment of the present invention;

FIG. 7 is perspective view of the cover of the base, in accordance with one embodiment of the present invention;

FIG. 8 is perspective view of the annular retaining ring of the bas, in accordance with one embodiment of the present invention;

FIG. 9 is a top view of the retaining ring of FIG. 8;

FIG. 10 is a side view of the retaining ring of FIG. 8, on the side having the taller section;

FIG. 11 is another side view of the retaining ring of FIG. 8, on the side having the shorter section;

DETAILED DESCRIPTON OF DRAWINGS

The present description is of the best presently contemplated mode of carrying out the invention. This description is made for the purpose of illustrating the general principles of the invention and should not be taken in a limiting sense. The scope of the invention is best determined by reference to the appended claims.

This invention has been described herein in reference to various embodiments and drawings. It will be appreciated by those skilled in the art that variations and improvements may be accomplished in view of these teachings without deviating from the scope and spirit of the invention. By way of illustration, the present invention will be described in reference to paper towel rolls of the kind typically used in household kitchens. Other types of rolls of thin ply sheets may be used in connection with the present invention.

The paper towel roll has a tube shaped core that supports a continuous roll of paper towels. The width of the roll is larger than the diameter of a full roll of paper towels. Individual pieces of paper towels (e.g., rectangular shaped) are defined by perforations across the roll. The perforation defines lines of weakness in the roll, to facilitate tearing of the roll to separate the individual pieces of paper towels. Paper towel rolls of other shapes and sizes, with or without perforations, may be used with the present invention. As used herein, paper towel roll includes paper rolls that may comprise absorbent or not absorbent paper sheets.

Figure 1:
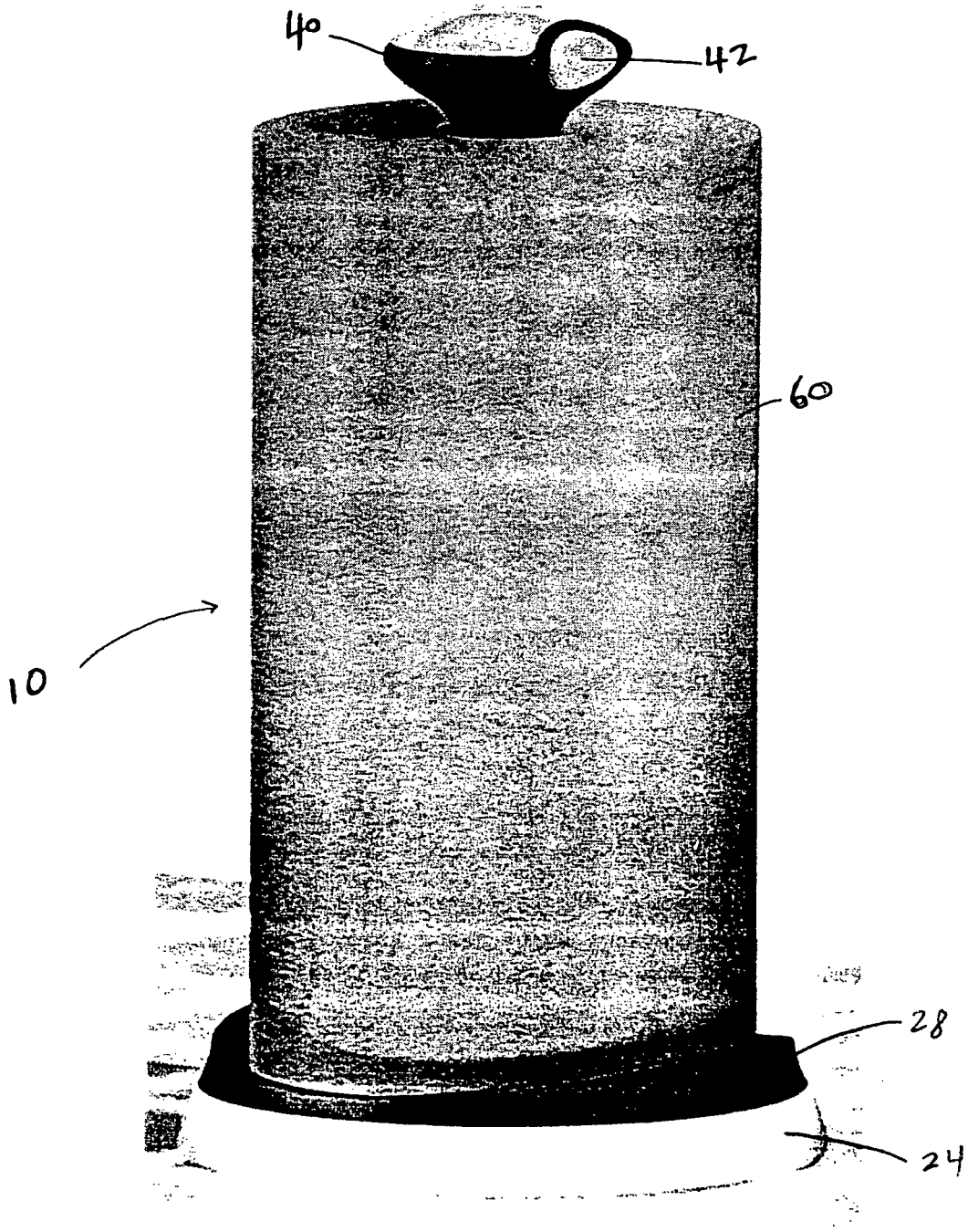
FIG. 1 is a perspective view of one embodiment of the paper towel holder of the present invention holding a roll of paper towels in place.
Figure 2:
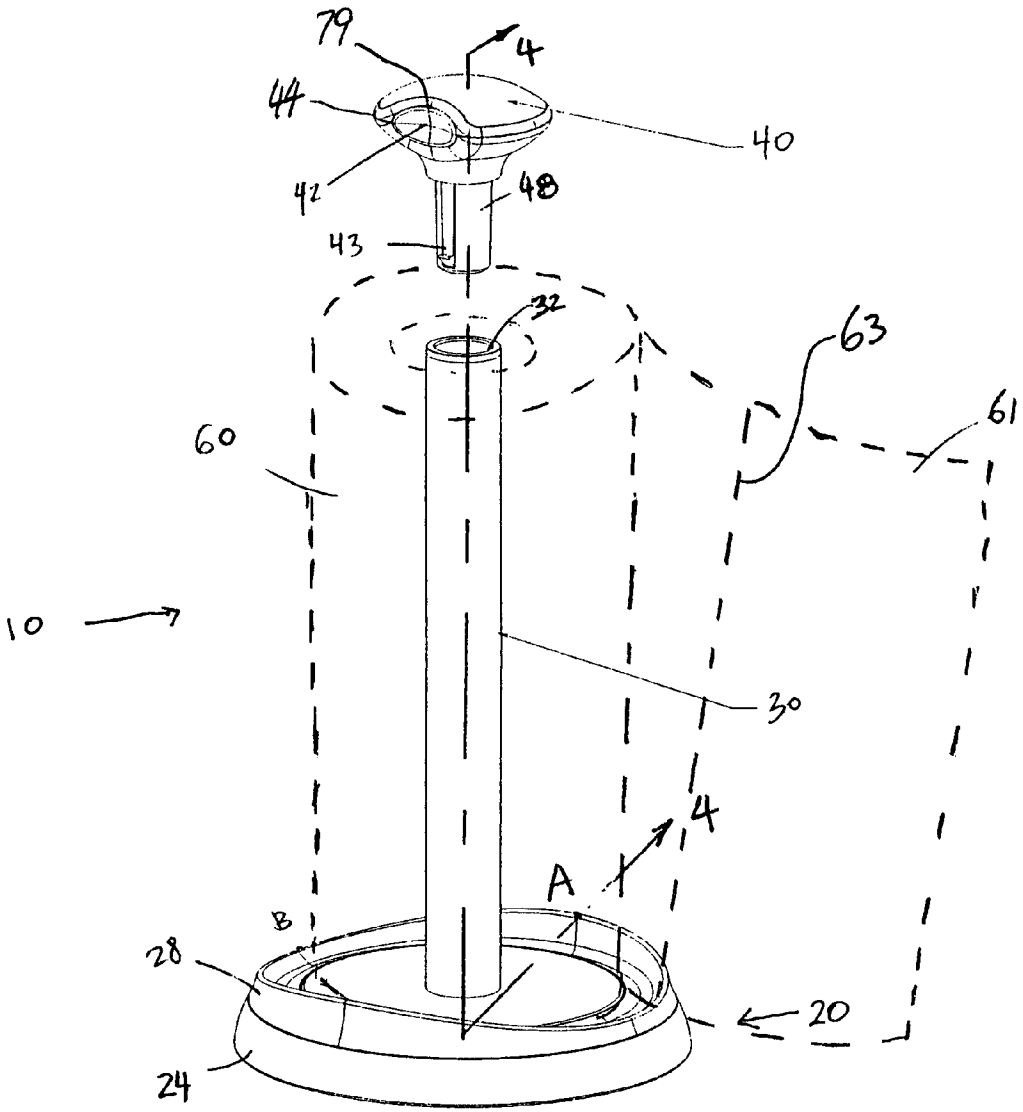
FIG. 2 is a perspective view the paper towel holder of the embodiment of the present invention.

In one embodiment of the present invention, the paper towel holder is of the type that is free-standing and portable, structured to support a paper towel roll with its axis oriented vertically. FIG. 1 is a perspective view of a paper towel holder 10 in accordance with one embodiment of the present invention, supporting a roll 60 of paper towels. FIG. 2 is a perspective view showing the holder 10 standing alone, with the paper towel roll 60 indicated by dotted lines. The holder 10 comprises primarily a pedestal or base 20, a pole in the form of a tube 30 vertically supported on the base 20, and a handle 40 releasably attached to the top distal end of the tube 30.

Figure 3:
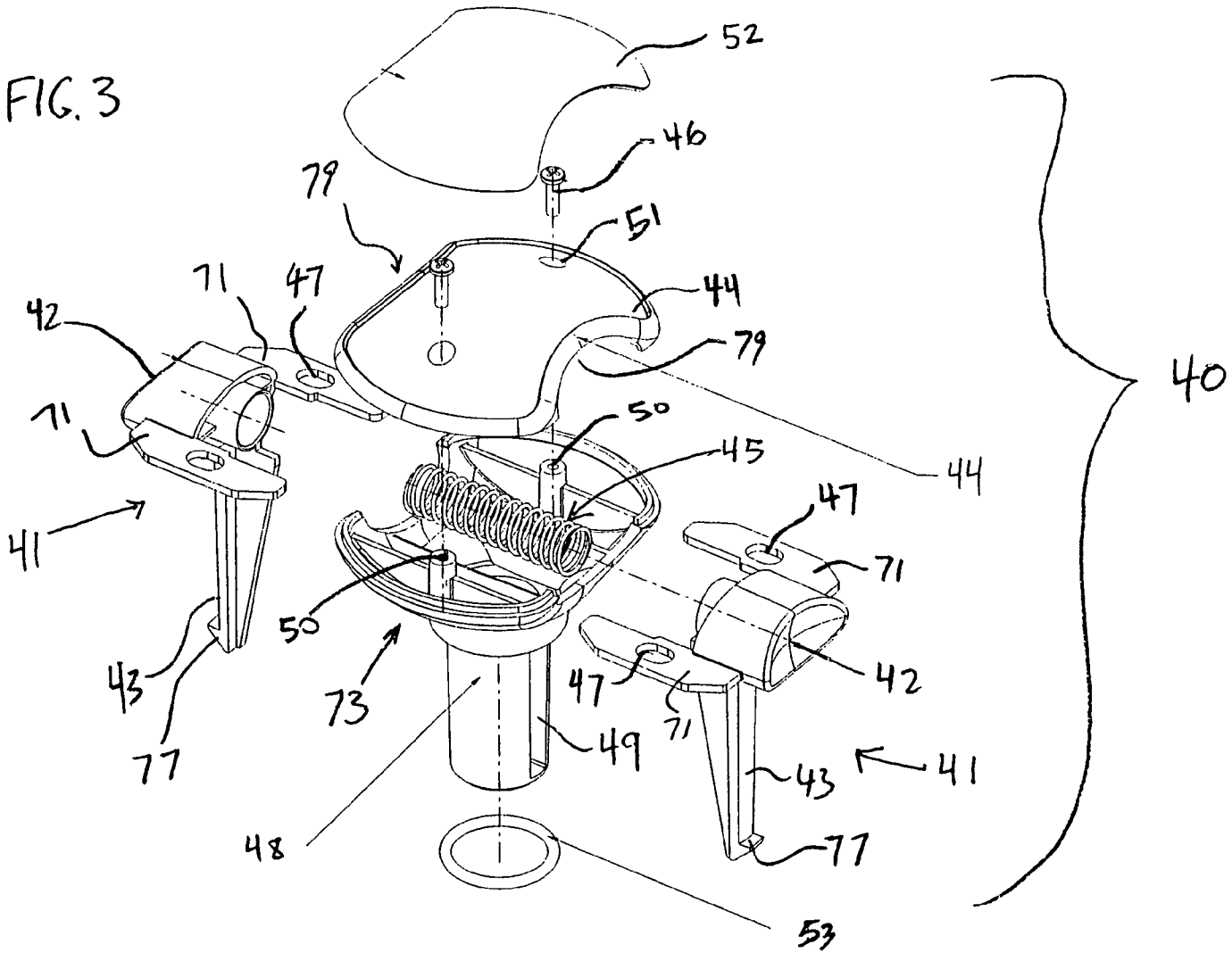
FIG. 3 is an exploded perspective view of the releasable handle of FIG. 2, in accordance with one embodiment of the present invention.

FIG. 3 is an exploded view of one embodiment of handle 40. The releasable handle 40 generally resembles a knob. The handle 40 comprises two release buttons 41, a body 73, and a cover 44. The structure of the release button 41 includes a button pad 42 attached to a latch 43, and a slider 71. The latch 43 has a hook 77 at its end. The slider 71 has oval holes 47 provided, which fit around the stubs 50 of the body 73. The oval holes 47 allow the slider 71 to slide relative to the stubs 50, in a radial direction as guided by the stubs 50. A hollow generally cylindrical or conical stem 48 extends from the bottom of the body 73. When assembled to the body 73, each latch 43 is inserted through the hollow stem 48, and has its hooks 77 extending through slots 49 in the stem 48. A spring 45 is provided to bias the two latches 43 away from each other, thereby exposing the hooks of the latch 43 through the slots 49 under bias of the spring 45. The cover 44 securely retains the spring and the holes 47 of the sliders 71 onto the stubs 50. Screws 46 are provided to secure the cover 44 in place on the body 73. A face-plate 52 provides a desirable external finish to the handle 40, concealing the screws 46. A spacer o-ring 53 may be provided around the stem 48 of the body 73. The body 73, cover 52 and/or the release button 41 may be may be molded from plastic. The face-plate 52 may be a thin sheet of metal, such as stainless steel or aluminum, having a polished or textured surface finish.

Figure 4:
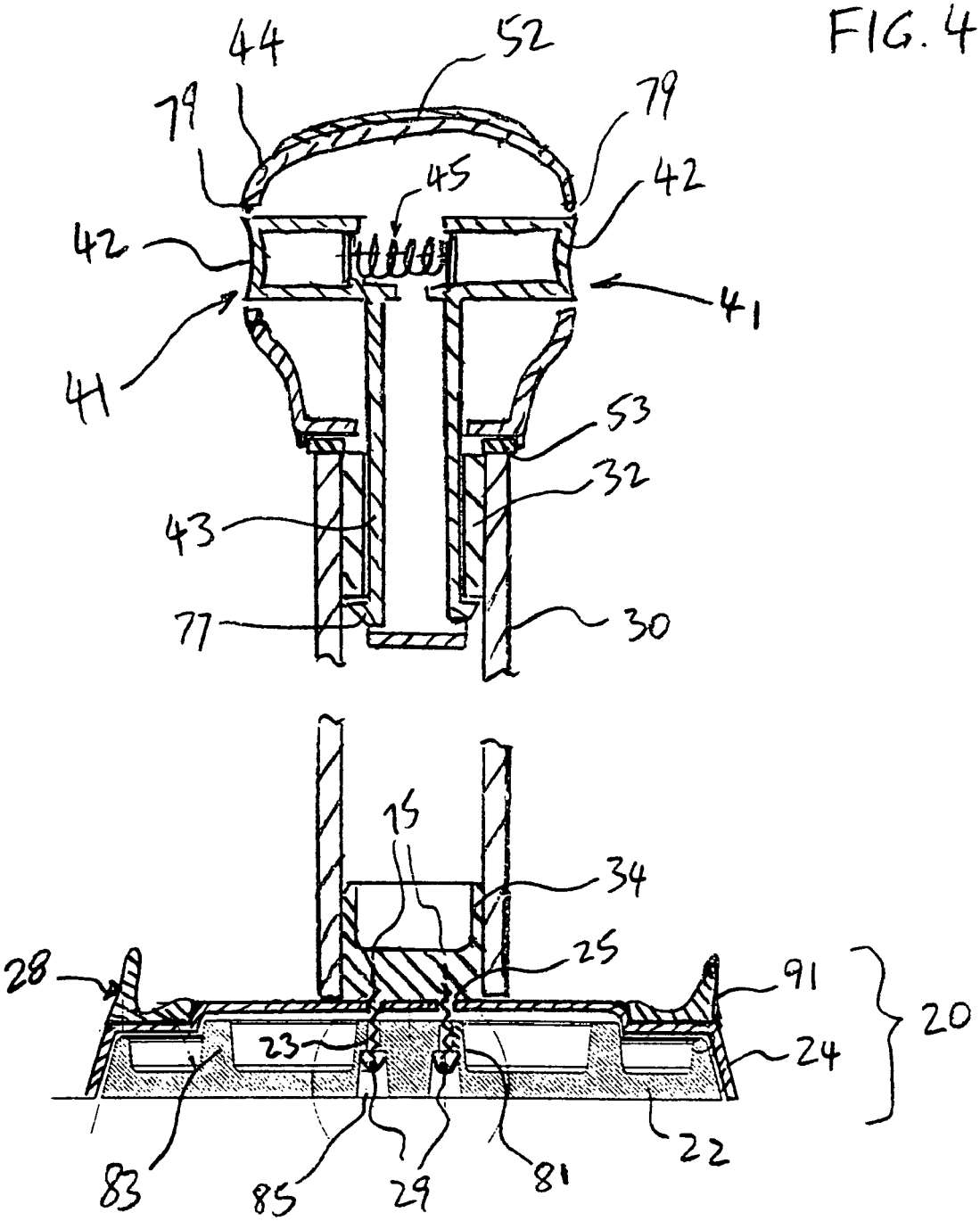
FIG. 4 is a cross-sectional view taken along line 4-4 of the paper towel holder of FIG. 2.

Referring to FIG. 4, the tube is hollow along its entire length. The tube may be made of metal (e.g., stainless steel or aluminum) or molded plastic, having a polished or textured surface finish. The external diameter of the tube 30 is sized to fit into the hollow hub of the paper towel roll 60, with a clearance to allow the relative rotation of the roll 60 with respect to the tube 30. At the top distal end of the tube 30, it has an inner diameter that is sized to receive a cylindrical insert 32, which may be made of rigid plastic. The inner diameter of the cylindrical insert 32 is sized to receive the stem 48 of the handle body 73. The length of the cylindrical insert 32 is such to allow the hooks 77 of the latch 43 to latch on to the lower edge of the cylindrical insert 32, when the handle body 73 is fully inserted into the cylindrical insert 32. To release the handle body 73 from the tube 30, the button pads 42 are depressed, such as by squeezing or pinching towards each other simultaneously against the spring bias, thereby retracting the hooks 77 to disengage from the bottom edge of the cylindrical insert 32.

Referring to FIGS. 1, 2, 3 and 4, it is noted that the knob shaped handle 40 has a generally convex profile with concave recesses 79 defined by the cover 44 and body 73, which recesses protect the button pads 42 from accidental depression. The button pads 42 are recessed from the surrounding convex body profile of the handle 40. In one embodiment, the button pads 42 are flush mounted in the concave recesses 79. The maximum extent of the exposed surfaces of the button pads 42 under the spring bias is substantially flush with the surrounding concave surface profile of the recesses 79 in the handle 40. That is, against the normal bias of the spring 45, the button pads 42 remain substantially flush with respect to the external surface of the handle 40. In another embodiment, the exposed surfaces of the button pads 42 generally do not extend appreciably beyond the surrounding concave recesses, such that even when the button pads 42 are pressed to the edge of the concave recesses, the hooks 77 do not disengage from the bottom edge of the cylindrical insert 32.

In order to release the handle 40 from the tube 30, the button pads 42 must be depressed with fingers to move the button pads 42 to below the edge of the recesses, so that the exposed surfaces of the button pads 42 are depressed into the body 74, below the surrounding concave surface profile of the recesses 79. This configuration of the release buttons 41 prevents accidental release of the handle 40, such as when she wishes to lift the holder 10 to relocate the holder, or to hold the holder in place with her hands. When a user grabs the handle 40 by placing her palm on the face-plate 52 on the cover 44, her fingers would wrap around the lower part of the handle body 73, but her finger tips would not be in contact with the button pads 42. Only when the user consciously depresses the button-pads 42 with her fingertips against the spring bias, can the handle 40 be released.

While the vertical pole for supporting the paper towel roll 60 is in the form of a uniform diameter tube 30 that is hollow along its entire length, it is well within the scope and spirit of the present invention, that the vertical pole may be embodied in the form of a solid or partial solid rod, having uniform or non-uniform inner and/or external diameter, with a cavity at the top distal end having a reduced diameter sized to receive the stem 48 of the handle body 73.

Referring to FIG. 4, the bottom end of the tube 30 is provided with a plug 34, which forms an anchor for mounting screws 29 that attach the tube 30 to the base 20, as will be further explained below. The plug 34 may be made of plastic, which is provided with guide holes 75 for receiving self-tapping screws 29.

Figure 5:
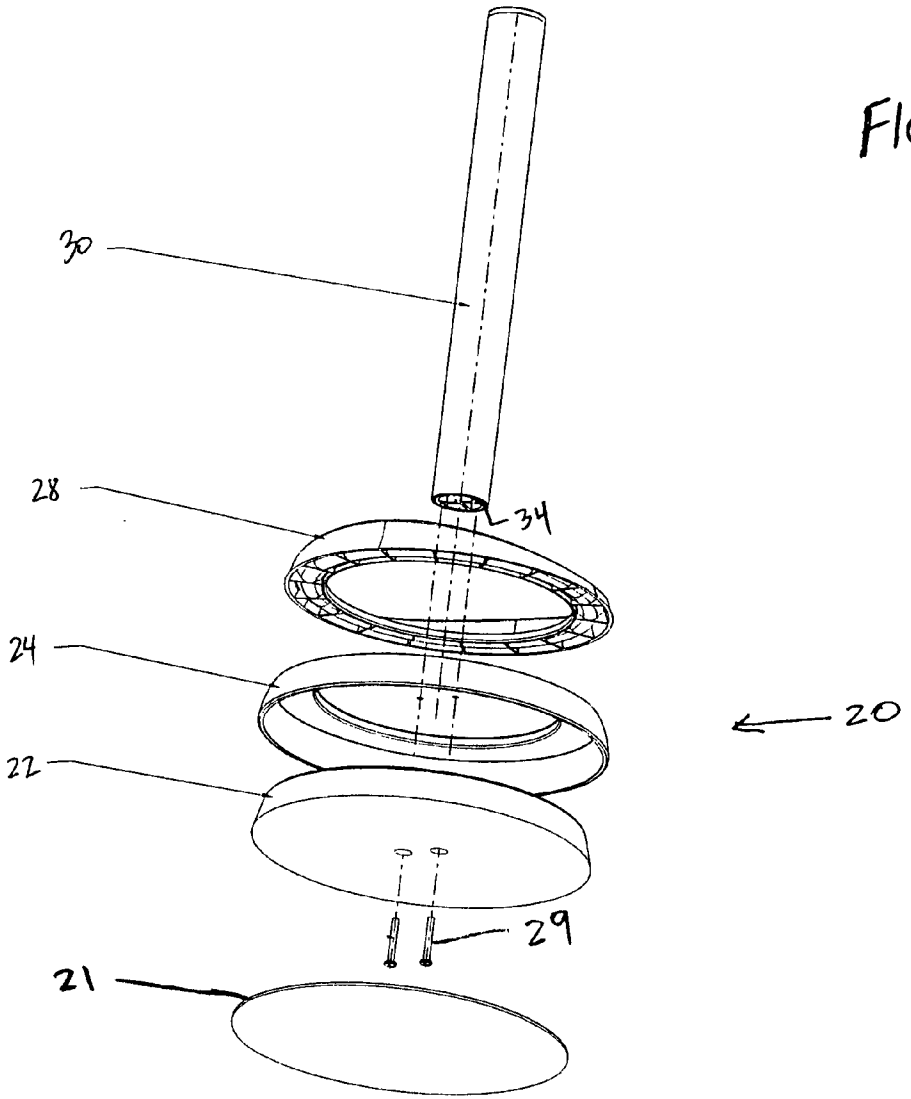
FIG. 5 is an exploded view showing the components of the base of the paper towel holder of FIG. 2, in accordance with one embodiment of the present invention.

FIG. 5 shows the components of the base 20, in accordance with one embodiment of the present invention. The base 20 comprises a weight 22, cover 24, and retaining ring 28. Referring also to FIG. 6, the weight 22 can be any material (e.g., metal such as lead, iron, etc.) of sufficient weight to provide the holder 10 with a weighted base to hold the holder 10 in place when a user pulls on the roll 60 and tears off a piece of paper towel using one hand, in the manner as will be further explained below. The configuration of the weight 20 may be structured to provide the desired weight. FIG. 6 illustrates a particular embodiment of the weight 22, having a concentric ring structure 83 and a center stub 81. If the weight 22 is in the form of a thick flat disc, it may be too heavy for the holder 10. The stub 81 provides the necessary thickness for mounting the tube 30. Specifically, the plug 34 is mounted to the stub 81, by applying the self-tapping screws 29 through clearance holes 85 in the stub 29, to thread to the guide holes provide in the plug 34.

Referring also to FIG. 7, the cover 24, resembling an inverted dish, covers the weight 22 (which may be unfinished), to provide a finished structure for the base 20. The cover 24 is provided with through holes 25 for receiving the screws 29. The top surface of the cover is provided with a raised center section 89 having an annular step 87, for fitting the retaining ring as further described below. The cover 24 may be made of plastic or metal, which may have a polished or textured finish. In the embodiment shown in FIG. 7, the cover 24 is made of stainless steel. A pad 21 may be provided below the weight 22, to provide a soft surface for resting on a support surface, such as a countertop. The pad 22 may comprise a material that prevents the base 20 from skidding on the support surface, and/or scratching the support surface.

In this embodiment, the base weight 22 and base cover 24 are in a circular configuration. They can be in other geometrical shapes, such as elliptical and polygonal shapes, without departing from the scope and spirit of the present invention.

Figure 13:
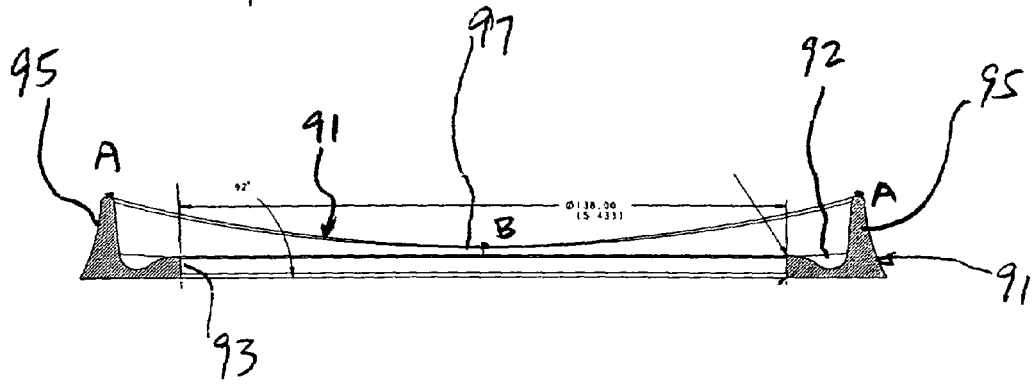
FIG. 13 is a cross-sectional view taken along line 13-13 of the retaining ring in FIG. 9.
Figure 12:
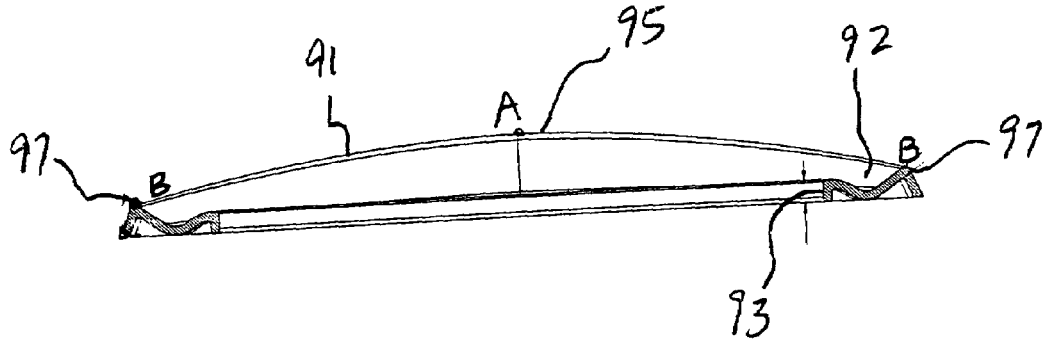
FIG. 12 is a cross-sectional view taken along line 12-12 of the retaining ring in FIG. 9.

Referring also to FIG. 8, the retaining ring 28 is supported on the base cover 24. FIGS. 8 to 14 illustrate the retaining ring 28 in accordance with one embodiment of the present invention. The retaining ring 28 has a structure in the form of an annulus, which can be made from molded plastic. As best seen in FIG. 13, the retaining ring 28 has an annular lip 91, an annular trench 92, and an annular inside wall 93. The annular inside wall has an inside diameter such that its surface can be interference fitted to the annular step 87 on the cover 24. The height of the annular inside wall 93 is about the same as the height of the raised center section 89 and the annular step 87 on the cover 24.

The annular lip 91 of the retaining ring 28 has uneven height circumferentially. Specifically, in the illustrated embodiment, the annular lip 91 has two taller lip sections 95 and two shorter lip sections 97. The taller lip sections 95 have highest point A, and the shorter lip sections have highest point B, as shown in the figures. The point B is higher than the height of the annular inside wall 93 and the height of the raised center section 89 and the annular step 87 on the cover 24. The annular lip 91 transitions gradually and smoothly from points A to points B around the circumference.

The annular lip 91 serves at least two purposes. First, it provides a barrier to prevent excessive unraveling of the paper towel roll 60 beyond the perimeter of the annular lip 91. When the retaining ring 28 is fitted over the cover 24, and a paper towel roll 60 is supported on the base 20, the bottom end of the paper towel roll 60 rests on the raised center section 89. The paper towel roll 60 may relax and unravel slightly, to extend the unraveled end to the annular lip 91, resting against the taller sections 95 and/or the shorter sections 97. Further unraveling is prevented by the annular lip 91.

Figure 14:
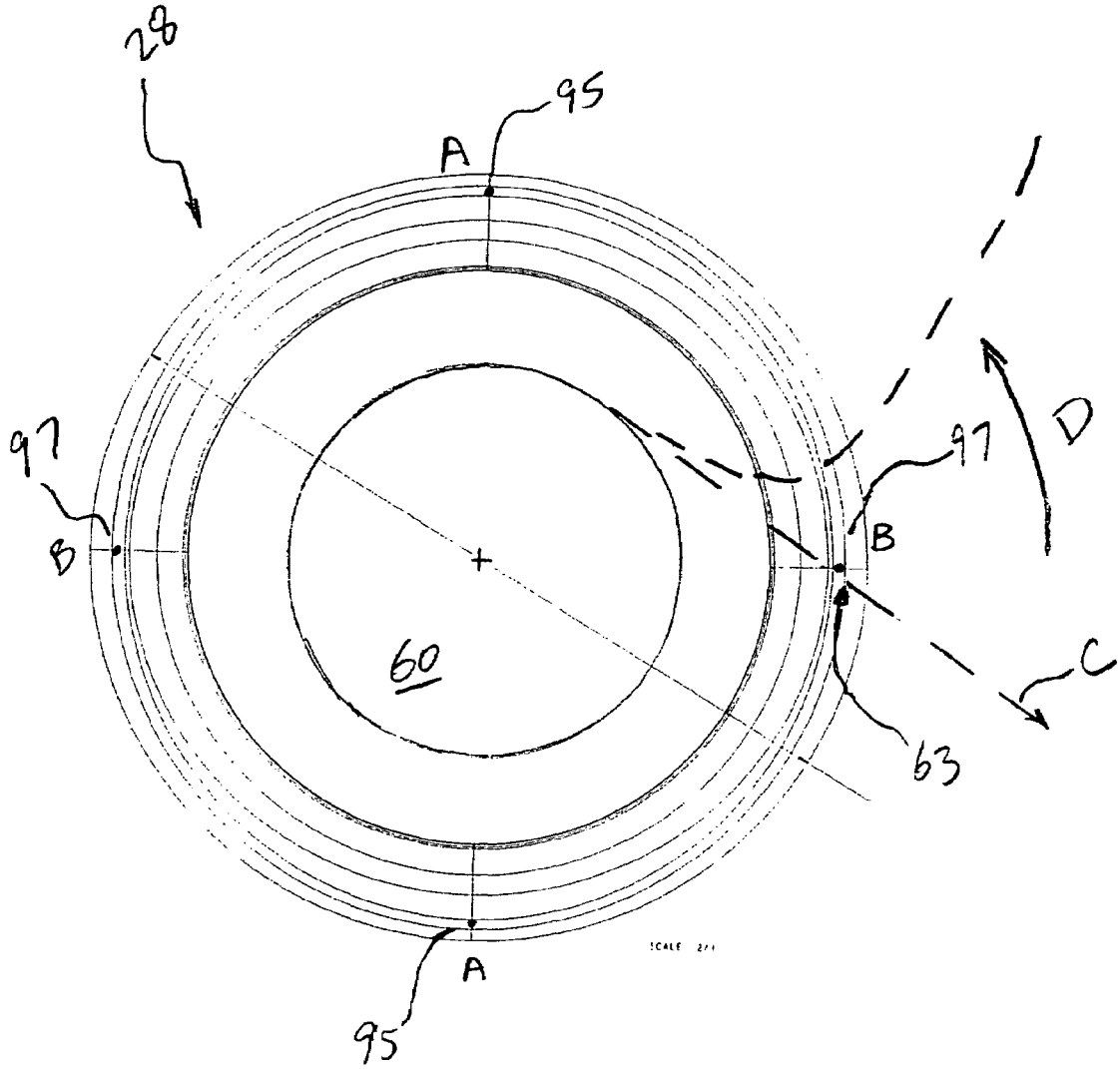
FIG. 14 is a top view of the paper towel holder.

Second, the annular lip 91 provides a structure that facilitates tearing off an individual piece of paper towel from the roll. The shorter sections 97 of the annular lip 91 do not present too much obstruction to the necessary unrolling of the roll when an end piece is pulled from the roll before it is to be torn off. Referring to FIG. 2, initially the end piece 61 is tugged roughly tangentially to the bulk of the roll 60 to unroll the end piece 61, along a direction (direction C indicated in FIG. 4) generally above and about the point B, until the perforation 63 is roughly above the point B. The taller sections 95 of the annular rim provide a structure that facilitates the tearing of the end piece of paper towel 61 from the roll 60. Referring to FIG. 14, to tear off the end piece 61, it is further tugged, and with a slight downward motion, and "peeled" in the general direction D, the bottom edge of the end piece 61 rub against the annular lip 91. Specifically, the bottom edge of the end piece 61 is caused to slide from generally point B of the shorter section 97 towards point A of the taller section 95. The sliding or rubbing action creates sufficient resistance to hold the bulk of the roll 60 against the continuous tugging of the end piece 61. The action and reaction between the tugging force and this resistance, and further the sliding or rubbing action against the annular lip section 95, cause the end piece 61 to initiate and tear at the perforation 63, and further tugging and peeling would tear the end piece 61 completely off from the roll 60. The tearing may occur prior to reaching point A.

As can be appreciated, the tearing of the end piece 61 by the above described "tug and peel" action can be achieved by using one hand, without the assistance of another hand to hold the roll from further unrolling. Given the weighted base 20 of the holder 10, the holder 10 would be sturdy enough to stay in place during the process, without the need to use another hand on the holder. This facilitates dispensing of paper towels, especially in a work environment such as a kitchen, in which one hand of the user may be occupied, while the other hand is the only hand available to tear off a piece of paper towel. The paper towel roll 60 may be placed on the holder 10 in opposite orientation as illustrated. For example, a user who is left-handed may prefer to have the paper towel roll 60 be placed to unroll and unravel in a counter-clockwise manner.

The uneven annular rim having the combination of tall and short sections provides an ideal balance between effectively holding the towel from excess unraveling, and facilitating ease of tearing of paper towel pieces from the roll. In one embodiment, the cover 24 is made of stainless steel, and the retaining ring 28 is made of molded plastic. The cover 24, enclosing the weight 22, provides a sturdy platform with a durable finish. The plastic rim enables sufficient height that is effective at preventing excessive unraveling of the roll. It has been found that a metal such as stainless steel may not be as suitable a material as plastic, since stainless steel is not as easy to roll form the annular lip of sufficient height.

Figure 15:
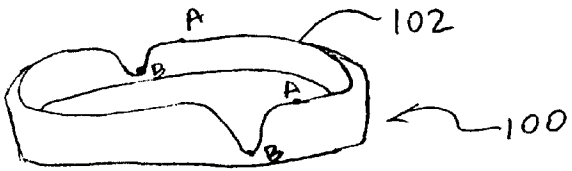
FIGS. 15 to 17 illustrates the rim profile of the retaining ring in accordance with additional embodiments of the present invention.
Figure 16:
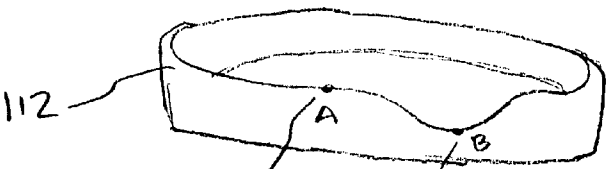
Figure 17:
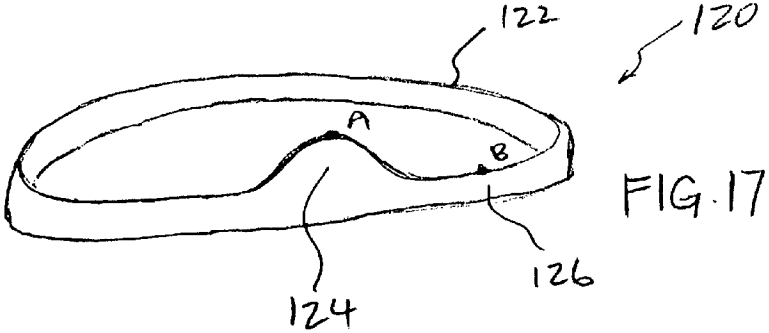

The retaining ring may be provided with annular lip profiles that are different from that shown in FIG. 8. For example, FIG. 15 illustrates another embodiment of the retaining ring 100, in which changes in the uneven annular lip 102 is more abrupt between point A and point B. Instead of a symmetrical retaining ring 28 having an annular lip 91 with two taller sections 95 and two shorter sections 97, alternatively as shown in FIG. 16, the retaining ring 110 may comprise an annular lip 112 with a single continuous taller section 114 and a single shorter section 116. Further (not shown), more than two taller sections 95 and shorter sections 97 may be provided for the annular lip 91. In another embodiment shown in FIG. 17, the uneven retaining ring 120 may have a single continuous shorter section 126 with only a single taller section 124. Alternatively (not shown), two or more taller sections 124 may be provided.

Figure 18:
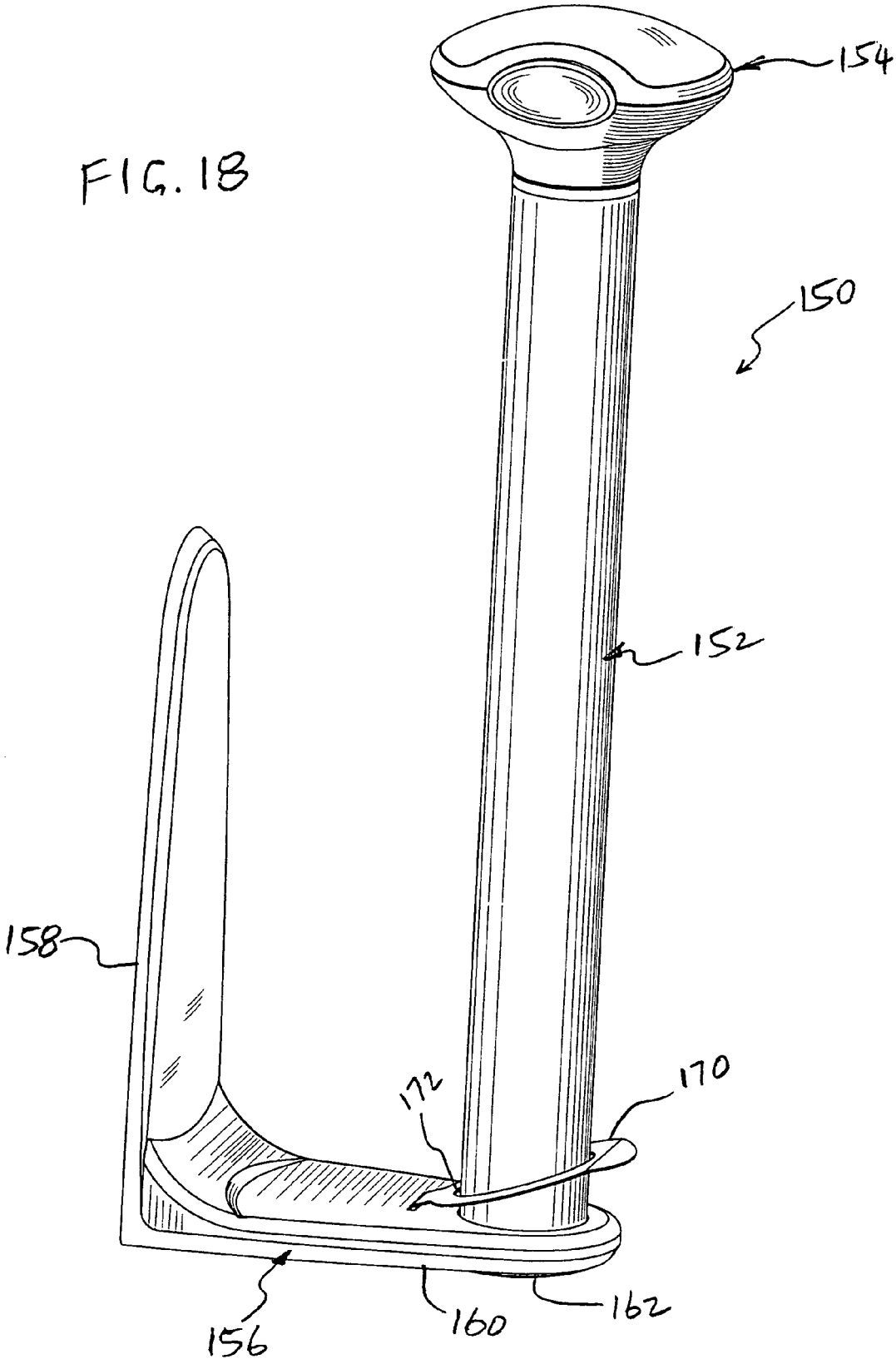
FIG. 18 is a perspective view of a paper towel holder in accordance with another embodiment of the present invention.
Figure 19:
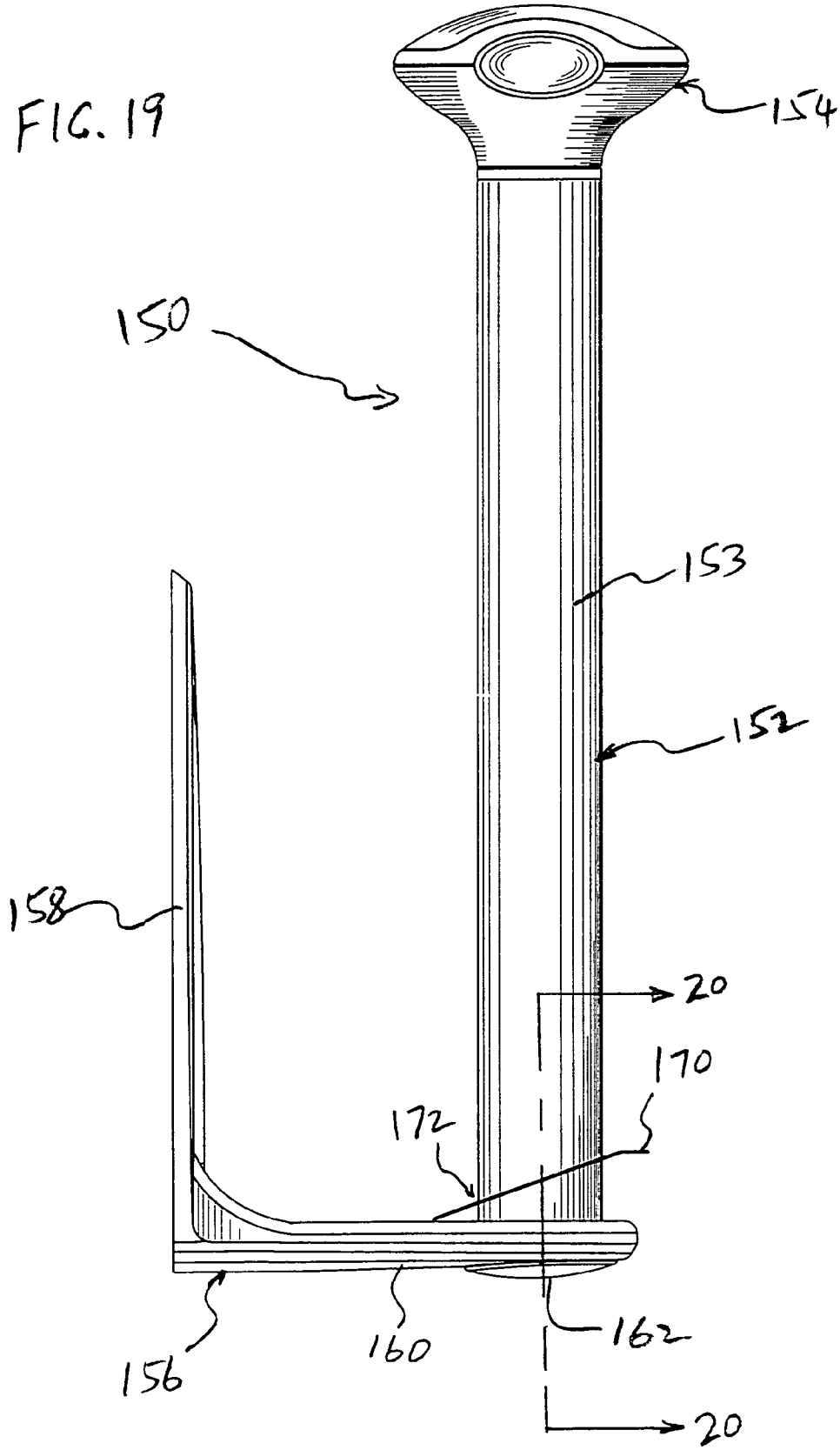
FIG. 19 is a side view of the paper towel holder of FIG. 18.
Figure 20:
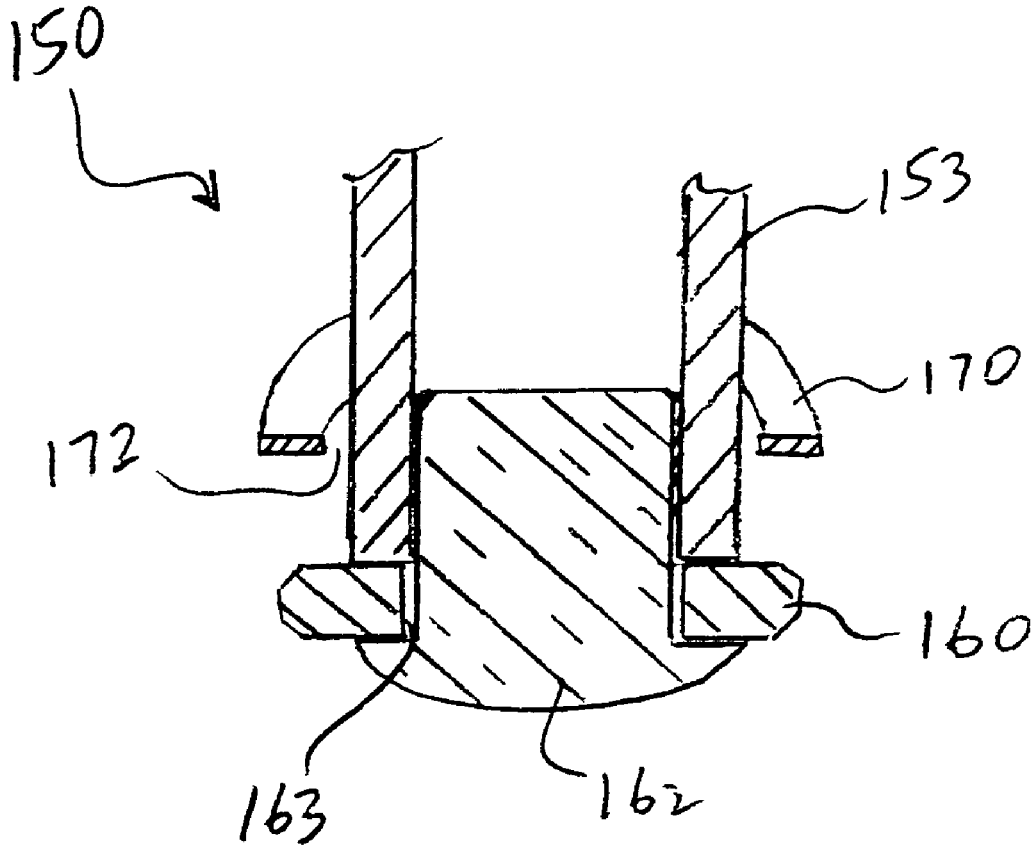
FIG. 20 is a sectional view taken along line 20-20 in FIG. 18.

FIGS. 18 to 20 illustrates an embodiment of the paper towel holder in accordance with a further aspect of the present invention. In this aspect, the paper towel holder is structured for mounting to a vertical surface, such as a wall or the side of a cabinet.

FIG. 18 is a perspective view of a paper towel holder 150 in accordance with one embodiment of the present invention, for supporting a roll of paper towels (not shown, but similar to paper towel roll 60 in the previous embodiment). The holder 150 comprises primarily a pole 152, a handle 154 and a base 156. The handle 154 may be similar to the handle 40 in the earlier embodiment.

The base 156 is generally L-shaped, including a horizontal base section 160 and a vertical mounting section 158. The mounting section 158 may be provided with screw holes (not shown) for mounting screws, or mounting tracks (not shown) at the back of the mounting section for concealed mounting to a mounting bracket on a vertical surface. This sort of conceal mounting is well know in the mounting art. The base section 160 is provided with a clearance hole 163 for receiving a mounting plug 162, as further discussed below.

The pole 152 may comprise a tube 153 similar to the tube 30 in the earlier embodiment. The top end of the tube 153 is similarly structured to work with the handle 154. The mounting of the tube 153 on the base 156 is different from the earlier embodiment. Instead of a plug for anchoring mounting screws as in the earlier embodiment, a plug 162 is provided to interference fit into the open bottom end of the tube 153, through the clearance hole 163 provided in the base section 160. The plug 162 may include barbed surface features (not shown) around its cylindrical body to provide better friction fit. The tube 153 is thus cantilevered and extends from the base section 160.

A spring 170 is provided, cantilevered and extending from the base section 160 (e.g., in the form of a metal leaf-spring). The spring 170 is has a generally ring-shaped section, having an aperture 172 that fits coaxially around the tube 153, with sufficient clearance with respect to the tube 153 over the designed range of travel of the spring 170. When a paper towel roll is loaded on the holder, the hub of the paper towel roll would be supported by the tube 153, with the bottom end of the hub resting on the spring 170. The weight of the roll would depress the spring 170, creating an upward reaction bias force. During the process or dispensing an end piece of paper towel from the roll, the end piece is gently tugged to unroll the end piece. The reaction bias of the spring 170 creates sufficient resistance to the hub of the paper towel roll to tend to hold the roll in place from unrolling too much. The user can tear off the end piece using a slight upward or downward motion to initiate a tear at the perforation, and completing the tearing of the end piece from the roll.

The vertical mounting section 158 of the holder 150 provides a barrier to excessive unraveling of the paper towel roll. The end piece of the paper towel roll would unravel until it touches the mounting section 158.

The base 156 may be made of molded plastic, or metal, such as stainless steel. The handle 154 and tube 152 may be made of plastic or metal, as in the earlier embodiment.

Variations of the vertical mounted paper towel holder 150 may be implemented without departing from the scope and spirit of the present invention. For example, the holder 150 may be provided with a circular base including a similar retaining ring as in the earlier embodiment. Such circular base may be coupled to a vertical mounting section for attachment to a vertical surface.

In the foregoing description of the various embodiments, the invention is described in reference to components that are shown to be separate discrete components. Some of these components may be integrated into a single unitary or monolithic structure, without departing from the scope and spirit of the present invention. For example, the retaining ring may be formed as an integral part of the cover. The vertical pole may be an integral part of the base. Similarly, some of the components may comprises two or more separate components coupled together. For example, for the vertical mount holder, the vertical mounting section may be coupled to a separate piece of base section by any attachment means.

While the invention has been particularly shown and described with reference to the preferred embodiments, it will be understood by those skilled in the art that various changes in form and detail may be made without departing from the spirit, scope, and teaching of the invention. A person skilled in the art will recognize that the holder incorporating the essence of this invention can also be used for holding a roll of thin ply sheets of other materials. Accordingly, the disclosed invention is to be considered merely as illustrative and limited in scope only as specified in the appended claims.

The invention claimed is:

1. A paper towel holder, comprising:

a base having an annular lip extending therefrom, wherein the annular lip is uneven in height circumferentially; and a pole having one end attached to the base, and a distal end extending upwardly from the base.

2. The paper towel holder as in claim 1, wherein the base comprises a base section to which the pole is attached, and a retaining ring defining the annular lip extending from the base section.

3. The paper towel holder as in claim 2, wherein the retaining ring and the base section are separate components, and the retaining ring is attached to the base.

4. The paper towel holder as in claim 3, wherein the base is made of metal, and the retaining ring is made of plastic.

5. The paper towel holder as in claim 3, wherein the base section comprises a cover to which the retaining ring is attached.

6. The paper towel holder as in claim 2, wherein to annular lip comprises at least a taller lip section and an adjoining shorter lip section.

7. The paper towel holder as in claim 6, wherein the shorter section transition smoothly to the taller lip section.

8. The paper towel holder as in claim 7, wherein the shorter section and taller section are symmetrical arranged circumferentially.

9. The paper towel holder as in claim 8, wherein the retaining ring has only two taller sections and two shorter sections symmetrically arranged circumferentially.

10. The paper towel holder as in claim 1, further comprising a handle releasable coupled to the distal end of the pole, said handle comprising at least one recessed release button that is activated to release the handle from the pole.

11. The paper towel holder as in claim 10, wherein the release button is recessed substantially flush with external profile of the handle, in a manner preventing accidental activation of the release button.

12. The paper towel holder as in claim 11, wherein the handle comprises two recessed release buttons.

13. A paper towel holder, comprising:

a base;

a pole having one end attached to the base, and a distal end extending upwardly from the base; and a handle releasably coupled to the distal end of the pole, said handle comprising at least one release button operatively coupled to a latch, and a spring biasing the latch to couple to the distal end of the pole, wherein the button is activated to retract the latch against spring bias to decouple the latch from the distal end of the pole, so as to release the handle from the pole.

14. The paper towel holder as in claim 13, wherein the latch extends into the pole, and the spring biases the latch towards the pole, wherein the button is activated to retract the latch, against spring bias, away from the pole to release the handle from the pole.

15. The paper towel holder as in claim 13, wherein the handle comprises two release buttons on the sides of the handle, each button is operatively coupled to a latch, and the spring biases each latch to couple to the distal end of the pole, wherein the buttons are activated by pressing the buttons towards each other to retract the latches against spring bias to decouple the latches from the distal end of the pole, so as to release the handle from the pole.

16. A paper towel holder, comprising:

a base a pole having one end attached to the base, and a distal end extending upwardly from the base a handle releasably coupled to the distal end of the pole; and a spring supported and positioned generally near the base, to bias against a downward load adjacent to the pole.

17. The paper towel holder as in claim 16, wherein the spring is a leaf-spring coaxial around with the pole.

18. The paper towel holder as in claim 17, wherein the base comprises a base section, and a vertical mounting section extending from the base section for mounting to a vertical surface.

19. A paper towel holder, comprising:

a base having a horizontal base section and a vertical mounting section coupled to the base section;

a pole having one end attached to the base section, and a distal end extending upwardly from the base section; and a spring supported and positioned on the base section, to bias against a downward load adjacent to the pole.

20. The paper towel holder as in claim 19, further comprising a handle releasable coupled to the distal end of the pole.

21. The paper towel holder as in claim 19, wherein said handle comprising at least one recessed release button that is activated to release the handle from the pole.

* * * * *

UNITED STATES PATENT AND TRADEMARK OFFICE

CERTIFICATE OF CORRECTION

PATENT NO. : 7,530,525 B2
APPLICATION NO. : 11/094808
DATED : May 12, 2009
INVENTOR(S) : Yang et al.

It is certified that error appears in the above-identified patent and that said Letters Patent is hereby corrected as shown below:

Column 8, line 44, "to" should read --the--.

Signed and Sealed this

Twenty-fourth Day of November, 2009

David J. Kappos

David J. Kappos
*Director of the United States Patent and Trademark Office*